US008205277B2

(12) United States Patent
Yamasaki et al.

(10) Patent No.: US 8,205,277 B2
(45) Date of Patent: Jun. 26, 2012

(54) MANUFACTURING METHOD FOR MICRO-NANO BUBBLE BATHTUB WATER AND MICRO-NANO BUBBLE BATHTUB

(75) Inventors: Kazuyuki Yamasaki, Hiroshima (JP); Kazuyuki Sakata, Fukuyama (JP); Kazumi Chuhjoh, Takamatsu (JP); Masaki Kataoka, Fukuyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 1321 days.

(21) Appl. No.: 11/896,544

(22) Filed: Sep. 4, 2007

(65) Prior Publication Data

US 2008/0189847 A1 Aug. 14, 2008

(30) Foreign Application Priority Data

Sep. 28, 2006 (JP) ..... 2006-264171

(51) Int. Cl.
*A61H 33/02* (2006.01)

(52) U.S. Cl. ..... 4/541.4; 4/541.1; 4/541.5

(58) Field of Classification Search ..... 4/559, 541.1–541.5; 222/14, 56; 607/85–87

See application file for complete search history.

(56) References Cited

U.S. PATENT DOCUMENTS

| | | | | |
|---|---|---|---|---|
| 4,907,305 | A * | 3/1990 | Teramachi et al. | 4/541.4 |
| 5,206,963 | A * | 5/1993 | Wiens | 4/603 |
| 2006/0054205 | A1 | 3/2006 | Yabe et al. | |

FOREIGN PATENT DOCUMENTS

| | | | |
|---|---|---|---|
| JP | 6-63573 | A | 3/1994 |
| JP | 6-133882 | A | 5/1994 |
| JP | 7-236674 | A | 9/1995 |
| JP | 9-56614 | A | 3/1997 |
| JP | 200285949 | * | 9/2000 |
| JP | 2003-205228 | A | 7/2003 |
| JP | 2003-334548 | | 11/2003 |
| JP | 2004-121962 | | 4/2004 |
| JP | 2004-321959 | | 11/2004 |
| JP | 2006-239573 | A | 9/2006 |

OTHER PUBLICATIONS

Japanese Office Action mailed Jul. 15, 2008 in corresponding JP application 2006-264171.

* cited by examiner

*Primary Examiner* — Jason Boeckmann
(74) *Attorney, Agent, or Firm* — Nixon & Vanderhye PC

(57) ABSTRACT

In the upper part and the lower part of a micro-nano bubble generation section 34 in a micro-nano bubble bathtub 1, two kinds of micro-nano bubbles different in a size distribution are generated by first and second micro-nano bubble generators (submerged pump-type micro-nano bubble generator 2 and spiral flow-type micro-nano bubble generator 10) of two kinds, so that bathtub water containing micro-nano bubbles in a wide size distribution can be produced in a large amount. Some of the water containing micro-nano bubbles generated in the lower part is thrown into the first micro-nano bubble generator (spiral flow-type micro-nano bubble generator 10) in the upper part, so that the spiral flow-type micro-nano bubble generator 10 can generate micro-nano bubbles in a smaller size. Therefore, in this bathtub, micro-nano bubbles abundant in size and large in amount can be produced economically.

14 Claims, 11 Drawing Sheets

MANUFACTURING METHOD FOR MICRO-NANO BUBBLE BATHTUB WATER AND MICRO-NANO BUBBLE BATHTUB

CROSS REFERENCE OF RELATED APPLICATION

This nonprovisional application claims priority under 35 U.S.C. §119(a) on Patent Application No(s). 2006-264171 filed in Japan on Sep. 28, 2006, the entire contents of which are hereby incorporated by reference.

BACKGROUND OF THE INVENTION

The present invention relates to a manufacturing method for micro-nano bubble bathtub water and a micro-nano bubble bathtub utilizing two kinds of micro-nano bubble generators.

Conventionally, there were bathtubs using micro-nano bubble generators. However, in bathtubs using one kind of micro-nano bubble generators, the size range of generated micro-nano bubbles was small, and so the effect on human body, especially the extent of the influence on the flow of blood was limited.

There are many diabetics particularly in Japan, and there are some cases of leg amputation due to gangrene caused by deteriorated blood-flow near the tips of extremities. Although a bathtub system generating micro-nano bubbles could be considered as a remedy to deteriorated blood flow of human leg, a number of spiral flow-type micro-nano bubble generators should be installed to be effective. For example, there is a case in which ten spiral flow-type micro-nano bubble generators are installed. This case causes cost increase of the bathtub, making it unrealistic as a system.

Accordingly, micro-nano bubble bathtubs are being demanded which can generate a wide range of various micro-nano bubbles, which can generate micro-nano bubble in a large amount, and which is also economical.

Conventionally, a method and a device for generating micro-nano bubbles by using one kind of micro-nano bubble generator have been proposed.

In such conventional technology, a method and a device for utilizing nano bubbles are shown in JP 2004-121962 A. This conventional technology utilizes such characteristics of nano bubbles as decrease in buoyancy, increase in surface area, increase in surface activity, generation of local high pressure fields, a surface active property and an antiseptic property attained by achievement of electrostatic polarization. More specifically, it has been disclosed that by associating these characteristics with each other, a fouling component adsorption function, a substance surface high-speed cleaning and an antiseptic function allow advanced cleaning of various substances with low environmental load as well as purification of contaminated water.

In another conventional technology, a nano bubble generation method is disclosed in JP 2003-334548 A. This technology includes step (1) for gasifying part of liquid by decomposition, step (2) for applying ultrasonic waves to liquids, or step (3) composed of a step for gasifying part of liquid by decomposition and a step for applying ultrasonic waves.

In yet another conventional technology, a waste fluid treatment device using ozone micro bubbles is disclosed in JP 2004-321959 A. In this technology, ozone gas generated by an ozonizer and waste liquid drawn from the bottom of a treatment tank are fed to a micro bubble generator through a pressurization pump. In this technology, it is also disclosed that the waste fluid in the treatment tank is aerated by the generated ozone micro bubbles sent from the opening of a gas blow-off pipe.

SUMMARY OF THE INVENTION

An object of the present invention is to provide a manufacturing method for micro-nano bubble bathtub water and a micro-nano bubble bathtub, which can economically produce micro-nano bubbles abundant in size and large in amount.

In order to achieve the above object, there is provided a manufacturing method for micro-nano bubble bathtub water, comprising the steps for:

generating, in an upper part of a micro-nano bubble generation section, micro-nano bubbles smaller in size than micro-nano bubbles generated in a lower part of the micro-nano bubble generation section so as to generate two kinds of micro-nano bubbles different in size distribution of micro-nano bubbles;

throwing bathtub water from the lower part to the upper part of the micro-nano bubble generation section; and introducing the bathtub water containing micro-nano bubbles into a bathtub section from the micro-nano bubble generation section.

According to the manufacturing method for micro-nano bubble bathtub water in the present invention, micro-nano bubbles having a wide size distribution can be generated by generating micro-nano bubbles different in size distribution in the upper part and the lower part of the micro-nano bubble generation section. By introducing some of the micro-nano bubbles generated in the lower part to the upper part, it becomes easy to generate micro-nano bubbles in a smaller size distribution in the upper part, so that the micro-nano bubble water small in size distribution can be produced.

If the produced micro-nano bubble bathtub water is utilized as shower water, hair growth effect on the hair of head and cosmetic effect on wrinkles of the face can be expected by washing the hair of head and the face with the shower water.

Also, there is provided a micro-nano bubble bathtub, comprising:

a bathtub section; and a micro-nano bubble generation section including an upper part having a first micro-nano bubble generator placed therein and a lower part having a second micro-nano bubble generator placed therein and receiving bathtub water flowing from the lower part to the upper part, wherein the first micro-nano bubble generator generates micro-nano bubbles smaller in size than micro-nano bubbles generated by the second micro-nano bubble generator, and wherein bathtub water containing micro-nano bubbles is introduced into the bathtub section from the micro-nano bubble generation section.

In the micro-nano bubble bathtub of this embodiment, in the upper part and the lower part of the micro-nano bubble generation section, two kinds of micro-nano bubbles different in size distribution are generated by first and second micro-nano bubble generators of two kinds, so that the bathtub water containing micro-nano bubbles in a wide size distribution can be produced in a large amount. Moreover, by throwing some of the water containing micro-nano bubbles generated in the lower part into the first micro-nano bubble generator in the upper part, the first micro-nano bubble generator can generate micro-nano bubbles in a smaller size.

When a shower function is available, the water containing micro-nano bubbles may be used as shower water to wash the hair of head and the face, so that the hair growth effect on the hair of head and the cosmetic effect on wrinkles of the face can be expected.

In one embodiment of the invention, the micro-nano bubble bathtub further comprises a hose for introducing bathtub water containing micro-nano bubbles into the bathtub section from the micro-nano bubble generation section, wherein the first micro-nano bubble generator is a micro-nano bubble generator involving high-speed whirling, while the second micro-nano bubble generator is a micro-nano bubble generator involving rotary stirring.

In the micro-nano bubble bathtub in the present embodiment, in the upper part of the micro-nano bubble generation section, the micro-nano bubbles in a relatively small size distribution are generated by the micro-nano bubble generator involving high-speed whirling, while in the lower part of the micro-nano bubble generation section, the micro-nano bubbles in a relatively large size distribution are generated by the micro-nano bubble generator involving rotary stirring. Therefore, in the micro-nano bubble generation section, micro-nano bubbles are generated by the upper part and the lower part micro-nano bubble generators of two kinds different in micro-nano bubble generation method, so that the micro-nano bubbles having a wide size distribution can be generated.

In the present embodiment, the bathtub water containing the micro-nano bubbles in a wide size distribution can directly be applied to affected parts using the hose (e.g., bellow hose).

In one embodiment of the invention, the micro-nano bubble bathtub further comprises a hose for introducing bathtub water containing micro-nano bubbles into the bathtub section from the micro-nano bubble generation section, wherein the first micro-nano bubble generator is a micro-nano bubble generator involving high-speed whirling, while the second micro-nano bubble generator is a micro-nano bubble generator using a pressure solution pump.

In the present embodiment, in the micro-nano bubble generation section, micro-nano bubbles are generated by the upper part and the lower part micro-nano bubble generators of two kinds different in micro-nano bubble generation method (micro-nano bubble generator involving high-speed whirling and micro-nano bubble generator using a pressure solution pump), so that the micro-nano bubbles having a wide size distribution can be generated. Moreover, the bathtub water containing the micro-nano bubbles in a wide size distribution can directly be applied to affected parts using the hose (e.g., bellow hose).

In one embodiment of the invention, the micro-nano bubble bathtub further comprises a hose for introducing bathtub water containing micro-nano bubbles into the bathtub section from the micro-nano bubble generation section, wherein the first micro-nano bubble generator is a micro-nano bubble generator involving high-speed whirling, while the second micro-nano bubble generator is a micro-nano bubble generator involving pressurization using a compressor.

In the present embodiment, in the micro-nano bubble generation section, micro-nano bubbles are generated by the upper part and the lower part micro-nano bubble generators of two kinds different in micro-nano bubble generation method (micro-nano bubble generator involving high-speed whirling and micro-nano bubble generator involving pressurization using a compressor), so that the micro-nano bubbles having a wide size distribution can be generated.

In one embodiment of the invention, the micro-nano bubble bathtub further comprises a hose for introducing bathtub water containing micro-nano bubbles into the bathtub section from the micro-nano bubble generation section, wherein the first micro-nano bubble generator is a micro-nano bubble generator involving high-speed whirling, while the second micro-nano bubble generator is a micro-nano bubble generator involving nozzle injection.

In the present embodiment, in the micro-nano bubble generation section, micro-nano bubbles are generated by the upper part and the lower part micro-nano bubble generators of two kinds different in micro-nano bubble generation method (micro-nano bubble generator involving high-speed whirling and micro-nano bubble generator involving nozzle injection), so that the micro-nano bubbles having a wide size distribution can be generated.

In one embodiment of the invention, the micro-nano bubble bathtub further comprises a suction tube placed in between the first micro-nano bubble generator and the second micro-nano bubble generator for supplying bathtub water to the first micro-nano bubble generator.

In the present embodiment, the suction tube introduces the bathtub water containing the micro-nano bubbles generated by the second micro-nano bubble generator into the first micro-nano bubble generator. Consequently in the micro-nano bubble generation section, bathtub water containing micro-nano bubbles is manufactured in two steps, and therefore in the first micro-nano bubble generator, new micro-nano bubbles can be manufactured while at the same time, micro-nano bubbles in a smaller size can be manufactured.

In one embodiment of the invention, the micro-nano bubble bathtub further comprises: a water pipe and a circulating pump for supplying the bathtub water in the micro-nano bubble generation section to the first micro-nano bubble generator; an air pipe for supplying air to the first micro-nano bubble generator; and a shower pipe for introducing the water containing micro-nano bubbles obtained from the water pipe to a shower section.

In the micro-nano bubble bathtub in the present embodiment, the bathtub water containing micro-nano bubbles obtained from the water pipe of the first micro-nano bubble generator can be used as shower water in the shower section through the shower pipe.

In one embodiment of the invention, the micro-nano bubble bathtub further comprises: a surfactant tank; a surfactant tank pump for pumping a surfactant from the surfactant tank to the bathtub section; a turbidimeter for detecting turbidity of bathtub water in the bathtub section; and a control section for controlling operation of the surfactant tank pump based on a turbidity detection signal outputted by the turbidimeter.

In the micro-nano bubble bathtub of this embodiment, a surfactant is sent out to the bathtub section from the surfactant tank in response to the turbidity of the bathtub water detected by the turbidimeter. As a result, the generation state of micro-nano bubbles can be managed with the turbidimeter, while at the same time, ideal micro-nano bubbles can be manufactured in the micro-nano bubble generation section.

In one embodiment of the invention, the surfactant is a body soap.

In the micro-nano bubble bathtub of this embodiment, the body soap is used as a surfactant, so that micro-nano bubbles can easily be manufactured at low costs.

In one embodiment of the invention, a carbon dioxide gas generating solid is put in the bathtub section.

In the micro-nano bubble bathtub in the present embodiment, the carbon dioxide gas generating solid put in the bathtub section makes it possible to manufacture the carbon dioxide micro-nano bubbles with use of the carbon dioxide gas generating solid.

In one embodiment of the invention, the micro-nano bubble generation section has a string-type polyvinylidene chloride filling placed under the second micro-nano bubble generator in the lower part.

In the micro-nano bubble bathtub in the present embodiment, the string-type polyvinylidene chloride filling placed in the lower part of the micro-nano bubble generation section makes it possible to treat "dirt" contained in the bathtub water.

In one embodiment of the invention, the micro-nano bubble generation section has a ring-type polyvinylidene chloride filling placed under the second micro-nano bubble generator in the lower part.

In the micro-nano bubble bathtub in the present embodiment, the ring-type polyvinylidene chloride filling placed in the lower part of the micro-nano bubble generation section makes it possible to treat "dirt" contained in the bathtub water.

In one embodiment of the invention, a bath agent is added to the bathtub section.

In the micro-nano bubble bathtub in the present embodiment, a bath agent is added to the bathtub section so that ideal bathtub water containing micro-nano bubbles can be manufactured.

According to the manufacturing method for micro-nano bubble bathtub water in the present invention, micro-nano bubbles having a wide size distribution can be generated by generating micro-nano bubbles different in size distribution in the upper part and the lower part of the micro-nano bubble generation section. By introducing some of the micro-nano bubbles generated in the lower part into the upper part, it becomes easy to generate micro-nano bubbles in a smaller size distribution in the upper part, so that the micro-nano bubble water small in size distribution can easily be produced. If the produced micro-nano bubble bathtub water is utilized as shower water, hair growth effect on the hair of head and cosmetic effect on wrinkles of the face can be expected by washing the hair of head and the face with the shower water.

BRIEF DESCRIPTION OF THE DRAWINGS

The present invention will become more fully understood from the detailed description given hereinbelow and the accompanying drawings which are given by way of illustration only, and thus are not intended to limit the present invention, and wherein.

DETAILED DESCRIPTION OF THE INVENTION

Hereinbelow, the present invention will be described in details in conjunction with the embodiments with reference to the drawings.

(First Embodiment)

Figure 1:
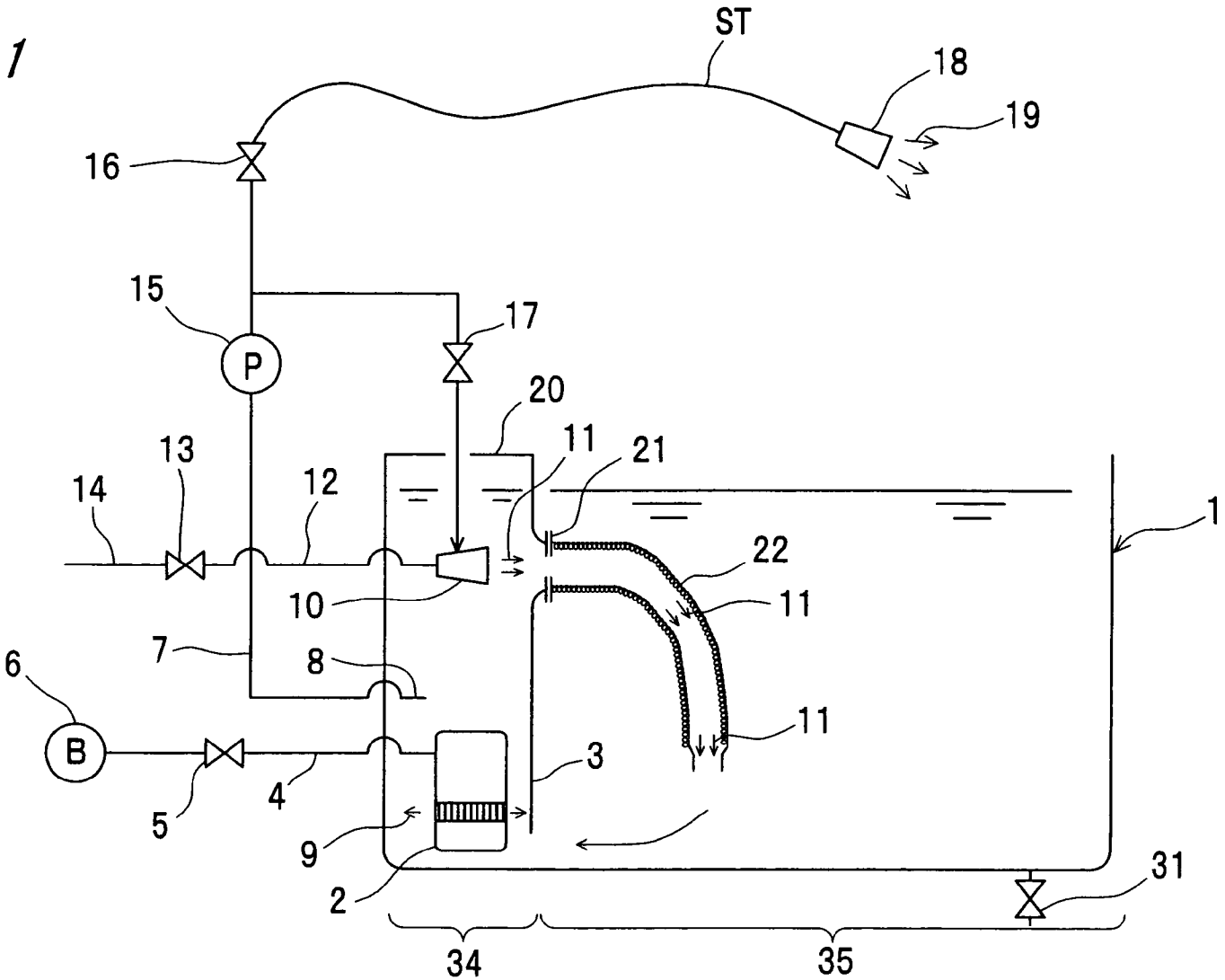
FIG. 1 is a schematic view showing a first embodiment of a micro-nano bubble bathtub in the present invention.

FIG. 1 is a schematic view showing a first embodiment of a micro-nano bubble bathtub in the present invention. The micro-nano bubble bathtub 1 includes a micro-nano bubble generation section 34 and a bathtub section 35. Although the micro-nano bubble generation section 34 and the bathtub section 35 are partitioned with a partition wall 3, the micro-nano bubble generation section 34 and the bathtub section 35 are connected at the lower end of the partition wall 3.

The micro-nano bubble generation section 34 has, from the bottom side, a submerged pump-type micro-nano bubble generator 2 having a blower 6, a suction tube 8 connected to a circulating pump 15, and a spiral flow-type micro-nano bubble generator 10 connected to the circulating pump 15 through a pipe 7. The micro-nano bubble generation section 34 has an equipment section covering 20 placed above the spiral flow-type micro-nano bubble generator 10 as a micro-nano bubble generator involving high-speed whirling.

Although the second micro-nano bubble generator was embodied by the submerged pump-type micro-nano bubble generator 2 which was a micro-nano bubble generator involving rotary stirring in the present embodiment, the second micro-nano bubble generator may be any one of a micro-nano bubble generator using a pressure solution pump, a micro-nano bubble generator involving pressurization using a compressor and a micro-nano bubble generator involving nozzle injection.

The blower 6 and the submerged pump-type micro-nano bubble generator 2 are connected through an air pipe 4, and a valve 5 is placed on the air pipe 4, so that the amount of air to the submerged pump-type micro-nano bubble generator 2 can be regulated.

The submerged pump-type micro-nano bubble generator 2 generates micro-nano bubbles relatively large in size as compared with the spiral flow-type micro-nano bubble generator 10, and forms a micro-nano bubble water stream 9. That is, the size of the micro-nano bubbles generated by the submerged pump-type micro-nano bubble generator 2 is distributed over the side of larger sizes as compared with the size of the micro-nano bubbles generated by the spiral flow-type micro-nano bubble generator 10.

In the spiral flow-type micro-nano bubble generator 10, air is taken in by an air suction pipe 14, a needle valve 13 and an air pipe 12, while bathtub water is sucked from a suction tube 8 with the circulating pump 15, and the amount of sucked water is adjusted by a valve 17. Consequently, the spiral flow-type micro-nano bubble generator 10 generates micro-nano bubbles with a relatively small size, and forms a micro-nano bubble water stream 11.

It is to be noted that the a large amount of micro-nano bubbles generated by the submerged pump-type micro-nano bubble generator 2 placed in the lower part of the micro-nano bubble generation section 34 are sucked in from the suction tube 8 of the spiral flow-type micro-nano bubble generator 10, so that some of the micro-nano bubbles turn into micro-nano bubbles with a smaller size by the spiral flow-type micro-nano bubble generator 10. In this way, micro-nano bubbles small in size and large in amount can be generated by two kinds of micro-nano bubble generators 2 and 10 placed in the lower part and the upper part of the micro-nano bubble generation section 34.

In a concrete example, the air suction amount of the submerged pump-type micro-nano bubble generator 2 may be 51./min. and the air suction amount of the spiral flow-type micro-nano bubble generator 10 may be 11./min., and therefore it can be said that the amount of air of 11./min. is effective for formation of small-size micro-nano bubbles. The air of 51./min. sucked by the submerged pump-type micro-nano bubble generator 2 forms micro-nano bubbles, and some of them are sucked in from the suction tube 8 of the spiral flow-type micro-nano bubble generator 10 and are formed into micro-nano bubbles with a smaller size by the spiral flow-type micro-nano bubble generator 10.

As a result, micro-nano bubbles abundant in size and large in amount are formed, and these micro-nano bubbles are discharged from a bellow-like hose 22. In FIG. 1, reference numeral 21 denotes a flange used for removing the bellow-like hose 22. It is to be noted that the bellow-like hose 22 has flexibility to allow bending and curving movements, i.e., to allow free movement. That is, with the bellow-like hose 22, the micro-nano bubble water stream 11 can freely be injected to areas of human body where application of the micro-nano bubble water stream is desired. For example, diabetics who suffer from feeling of numbness of the leg can apply micro-nano bubble water to the affected part of the leg having the numbness with use of the bellow-like hose 22. In order to fill the entire micro-nano bubble bathtub 1 with micro-nano bubbles to improve the entire blood flow of the human body, the device can be used with the bellow-like hose 22 removed by the flange 21.

Reference numeral 18 denotes a shower outlet, which is connected to a valve 16 through a shower tube ST. The valve 16 can be adjusted so that the bathtub water containing micro-nano bubbles can also be injected from the shower outlet 18. The valve 16 is connected to the water pipe 7 for water containing micro-nano bubbles via the circulating pump 15. The water pipe 7 for water containing micro-nano bubbles is linked to a suction tube 8. The shower outlet 18, the shower tube ST, and the valve 16 constitute a shower section. The pipe 7 constitutes a shower pipe.

Since the hair restoration effect of the water containing micro-nano bubbles on the hair of head and the cosmetic effect thereof on the wrinkles of the face have been proved, it is desirable to change the way of bathing in the micro-nano bubble bathtub 1 for elderly people especially with little hair of head as follows for example.

(1) Wash the hair of head and the face with the micro-nano bubble warm water as shower water 19 sprinkled from the shower outlet 18 in the shower section (utilizing clean bathtub water).

(2) After the hair of head and the face are washed with the shower water 19, put the human body into the bathtub section 35 to increase a blood flow rate (particularly for diabetics). It is to be noted that reference numeral 31 denotes a valve for draining the bathtub water from the micro-nano bubble bathtub 1.

Now, as described above, it is known that the micro-nano bubbles generated by the non-submerged pump-type (spiral flow-type) micro-nano bubble generator 10 are smaller in size than the micro-nano bubbles generated by the submerged pump-type micro-nano bubble generator 2. In the first embodiment, two sets of micro-nano bubble generators 10 and 2 which are different in performance are placed in the upper part and the lower part of the micro-nano bubble generation section 34.

Therefore, in the micro-nano bubble bathtub 1, slightly larger micro-nano bubbles are first produced in the submerged pump-type micro-nano bubble generator 2 in the lower part, and then the liquid containing these slightly larger micro-nano bubbles is introduced into the non-submerged pump-type (spiral flow-type) micro-nano bubble generator 10. Thus, more nano bubbles among micro-nano bubbles are generated in the micro-nano bubble generation section 34. The finer the bubbles become, the longer they exist in liquid to exert more effective action on the human body as an organism.

Commercially available devices by any manufacturers can be adopted as the submerged pump-type micro-nano bubble generator 2 for example. In this embodiment, by way of a concrete example, a device by Nomura Electronics Co., Ltd. was adopted. Although also by way of a concrete example, a product by Nanoplanet Research Institute Corporation was adopted as the non-submerged pump-type (spiral flow-type) micro-nano bubble generator 10, there are a number of other available products by other manufacturers, which may be selected depending on purposes.

Description is now given of three kinds of bubbles.

(i) Normal bubbles (air bubbles) ascend in water, and upon reaching the surface, they burst with a pop and disappear.

(ii) Micro bubbles are bubbles with an air bubble diameter of 10 to several dozen μm. Micro bubbles change to "micro-nano bubbles" with their contraction movements after generation.

(iii) Micro-nano bubbles are air bubbles having a diameter of 10 μm to around several hundred nm. The micro-nano bubbles can be described as the bubbles with the micro bubbles and the nano bubbles mixed together.

(iv) Nano bubbles are air bubbles having a diameter of several hundred nm or less.

It is to be noted that line mixer type diffusers cannot generate nano bubbles, but can generate a large amount of micro bubble.

(Second Embodiment)

Figure 2:
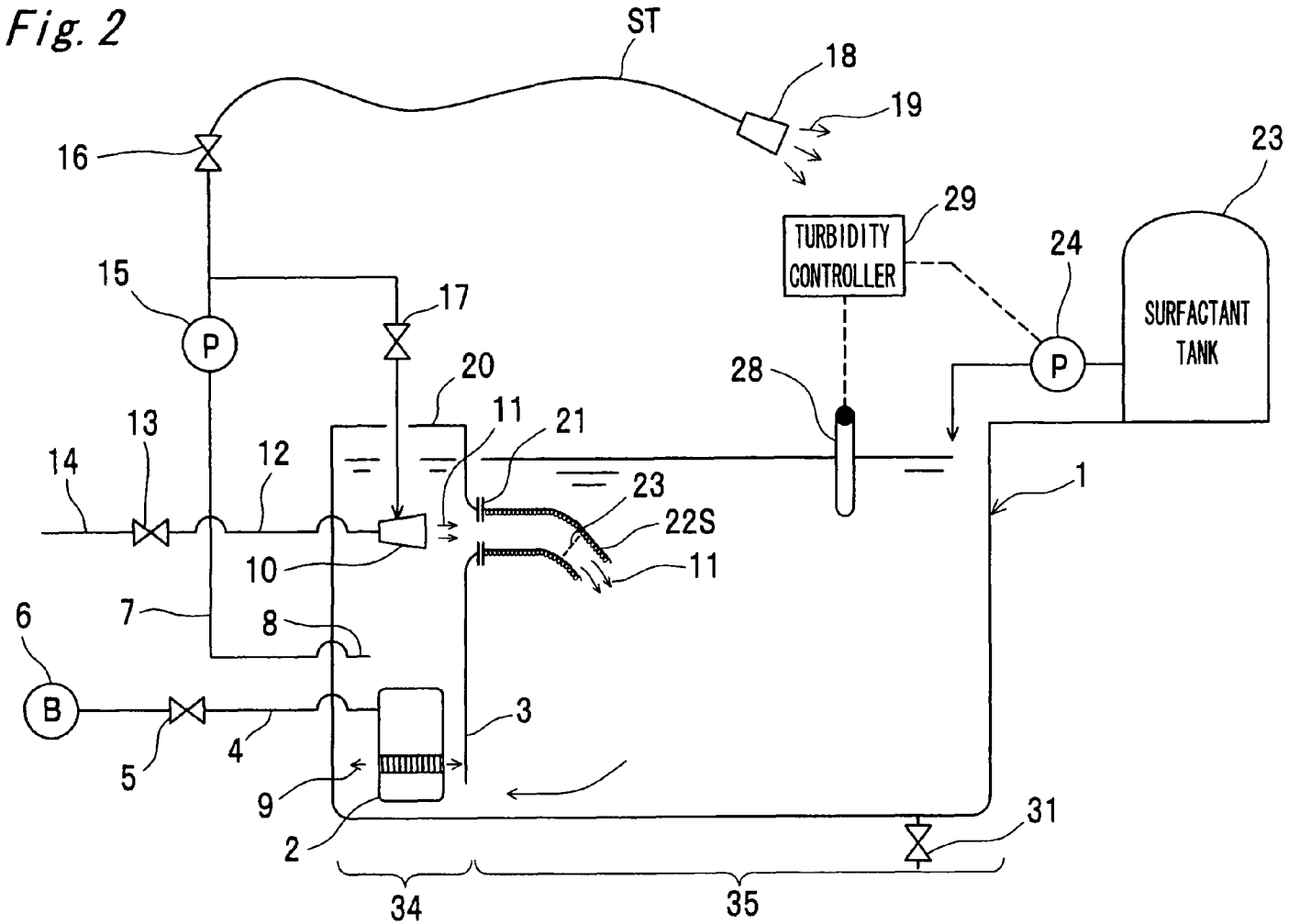
FIG. 2 is a schematic view showing a second embodiment of a micro-nano bubble bathtub in the present invention.

Next, FIG. 2 shows a second embodiment of a micro-nano bubble bathtub in the present invention. The second embodiment is different from the above-mentioned first embodiment in the point that a bellow hose 22S shorter than the bellow-like hose 22 of the first embodiment in FIG. 1 is provided, the point that a small perforated plate 33 placed in the bellow-like hose 22S is provided, and the point that a turbidimeter 28 placed in the micro-nano bubble bathtub 1, and a turbidity controller 29, a surfactant tank metering pump 24 and a surfactant tank 23 in cooperation with the turbidimeter 28 are newly provided.

Therefore, in this second embodiment, component members identical to those in the first embodiment are designated by identical reference numerals to omit detailed description, and description will mainly be given of the portions different from the first embodiment.

As shown in FIG. 2, since the bellow hose 22S shorter than the bellow-like hose 22 in first embodiment is provided and the small perforated plate 33 is placed in the bellow hose 22S in the second embodiment, the discharge pressure of a micro-nano bubble water stream 11 can be decreased. Therefore, a micro-nano bubble water stream can softly be applied to the entire human body in the bathtub section 35 of the bathtub 1.

In this second embodiment, the turbidimeter 28 is placed in the micro-nano bubble bathtub 1, and the turbidity controller 29, the surfactant tank metering pump 24 and the surfactant tank 23 in cooperation with the turbidimeter 28 are provided. Consequently, the turbidimeter 28 detects the turbidity of the bathtub water in the bathtub section 35, and outputs a turbidity detection signal to the turbidity controller 29 as a control section. The turbidity controller 29 controls operation of the surfactant tank pump 24 based on the turbidity detection signal from the turbidimeter 29.

With this control, the amount of micro-nano bubbles contained in the bathtub water in the bathtub section 35 is represented as the turbidity detected by the turbidimeter 28, and when the turbidity is smaller than a predetermined value, it means that the amount of micro-nano bubbles is not enough, and therefore body soap and the like are automatically supplied as a surfactant to the bathtub section 35 from the surfactant tank 23 with the surfactant tank pump 24. Consequently, the micro-nano bubble generation section 34 can generate optimal micro-nano bubbles. Thus, if the optimal micro-nano bubbles can be generated in the micro-nano bubble generation section 34, the blood stream of the human body soaked in the bathtub section 35 increases, and as the blood flow increases, a good effect on diseases with poor blood flow can be expected.

(Third Embodiment)

Figure 3:
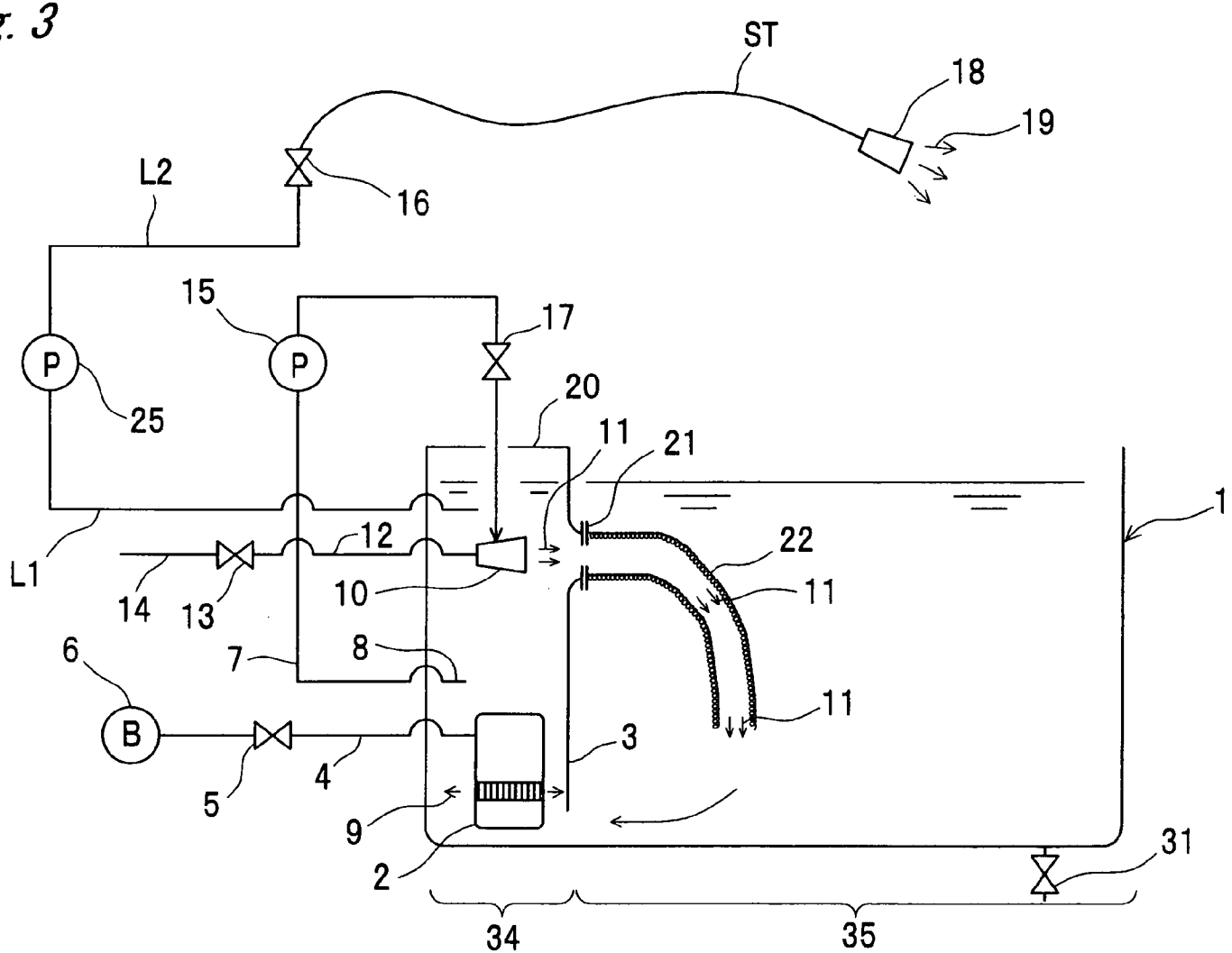
FIG. 3 is a schematic view showing a third embodiment of a micro-nano bubble bathtub in the present invention.

Next, FIG. 3 shows a third embodiment of a micro-nano bubble bathtub in the present invention. The third embodiment is different from the above-mentioned first embodiment in the point that the valve 16 in the shower section of the first embodiment in FIG. 1 is not connected to the pipe 7 but connected to a newly placed shower pump 25. Therefore, in this third embodiment, component members identical to those in the first embodiment in FIG. 1 are designated by identical reference numerals to omit detailed description, and description will mainly be given of the portions different from the first embodiment.

In the third embodiment, the shower pump 25 can pump bathtub water containing micro-nano bubbles above the spiral flow-type micro-nano bubble generator 10 in the upper part of the micro-nano bubble generation section 34 to the valve 16 from a pipe L2 via a pipe L1, and can sprinkle the bathtub water as shower water 19 from the shower outlet 18 through the shower tube ST.

Therefore, in the third embodiment, the operation of the shower pump 25 independent of the operation of the circulating pump 15 makes it possible to use a shower with the water containing micro-nano bubbles. The shower with the water containing micro-nano bubbles can be used for application such as washing the human body and washing the hair of head.

(Fourth Embodiment)

Figure 4:
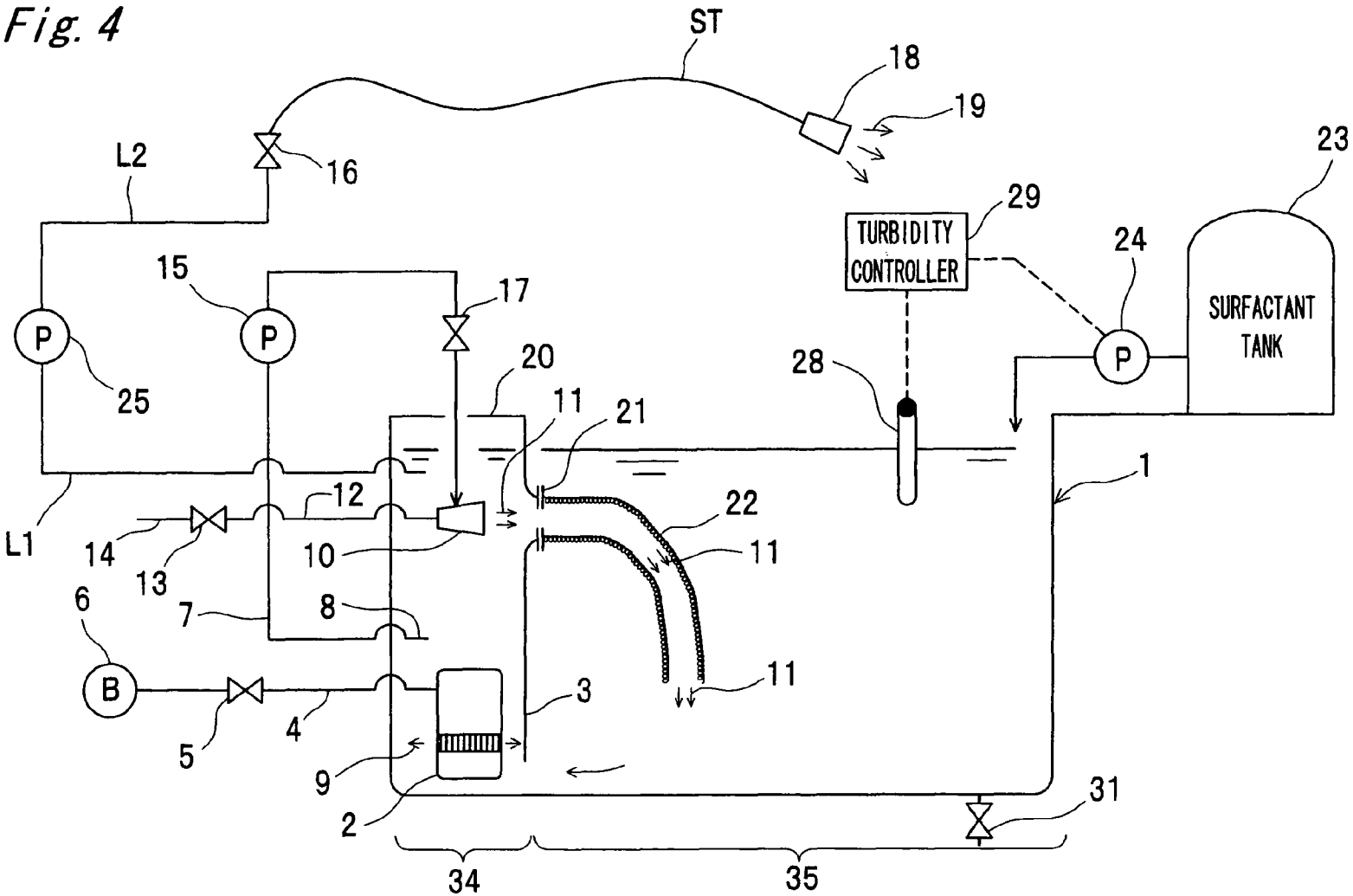
FIG. 4 is a schematic view showing a fourth embodiment of a micro-nano bubble bathtub in the present invention.

Next, FIG. 4 shows a fourth embodiment of a micro-nano bubble bathtub in the present invention. The fourth embodiment is different from the above-mentioned second embodiment in the point that the valve 16 in the shower section of the above-mentioned second embodiment is not connected to the pipe 7 but connected to a newly placed shower pump 25. Therefore, in this fourth embodiment, component members identical to those in the second embodiment in FIG. 2 are designated by identical reference numerals to omit detailed description, and description will mainly be given of the portions different from the second embodiment.

In the fourth embodiment, as in the above-mentioned third embodiment, the shower pump 25 can pump bathtub water containing micro-nano bubbles above the spiral flow-type micro-nano bubble generator 10 in the upper part of the micro-nano bubble generation section 34 to the valve 16 from a pipe L2 via a pipe L1, and can sprinkle the bathtub water as shower water 19 from the shower outlet 18 through the shower tube ST.

Therefore, in the fourth embodiment, the operation of the shower pump 25 independent of the operation of the circulating pump 15 makes it possible to use a shower with the water containing micro-nano bubbles. The shower with the water containing micro-nano bubbles can be used for application such as washing the human body and washing the hair of head.

(Fifth Embodiment)

Figure 5:
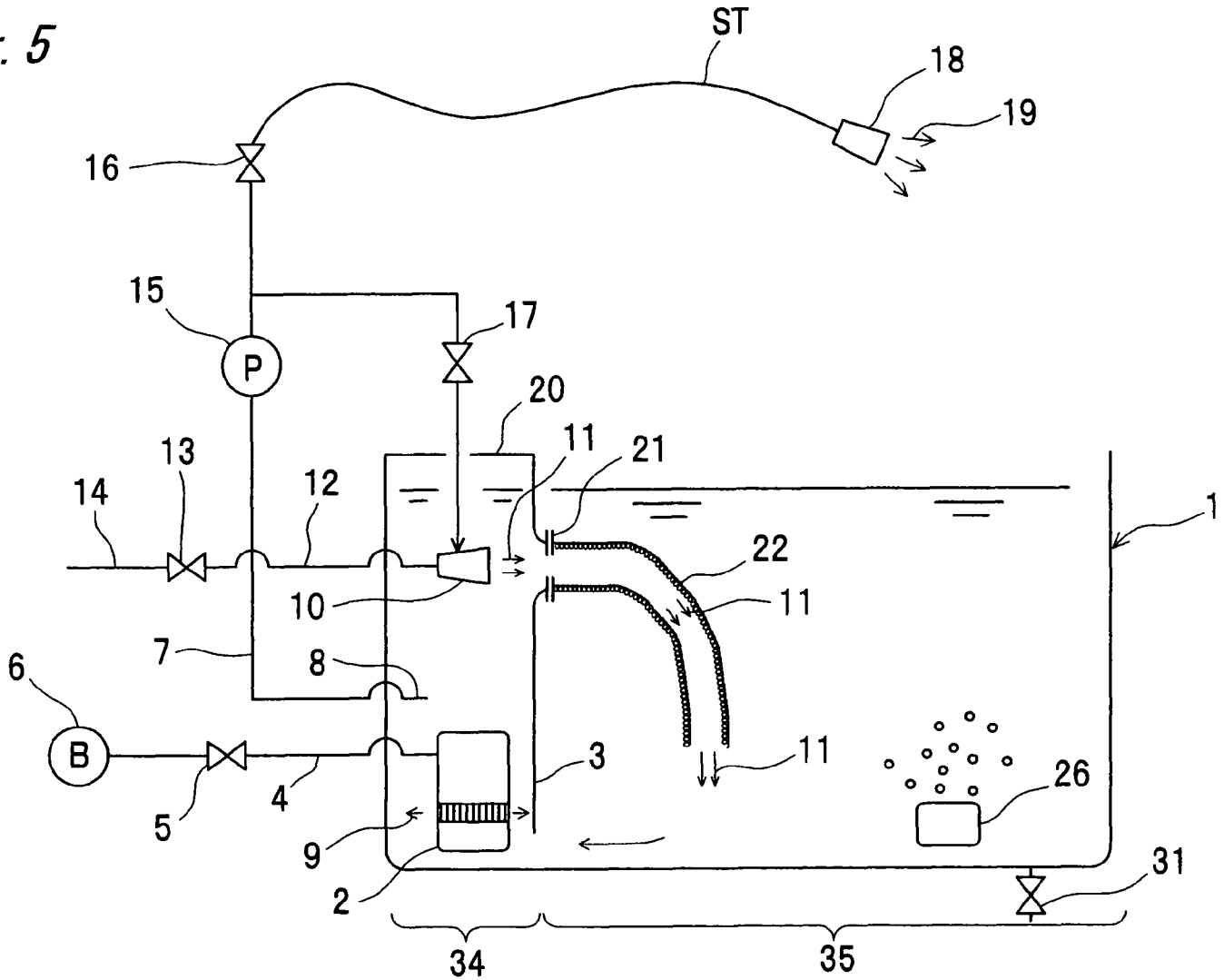
FIG. 5 is a schematic view showing a fifth embodiment of a micro-nano bubble bathtub in the present invention.

Next, FIG. 5 shows a fifth embodiment of a micro-nano bubble bathtub in the present invention. The fifth embodiment is different from the above-mentioned first embodiment in the point that a solid carbon dioxide generating material 26 is placed in the lower part of the bathtub section 35 of the micro-nano bubble bathtub 1 in the first embodiment of FIG. 1. Therefore, in this fifth embodiment, component members identical to those in the first embodiment are designated by identical reference numerals to omit detailed description, and description will mainly be given of the portions different from the first embodiment.

In the fifth embodiment, carbon dioxide gas micro-nano bubbles can be generated from the solid carbon dioxide generating material 26 placed in the lower part of the bathtub section 35 in the micro-nano bubble bathtub 1, so that the blood flow of the human body can be smoothened. Moreover, recovery from fatigue can be expected with the carbon dioxide gas micro-nano bubbles.

(Sixth Embodiment)

Figure 6:
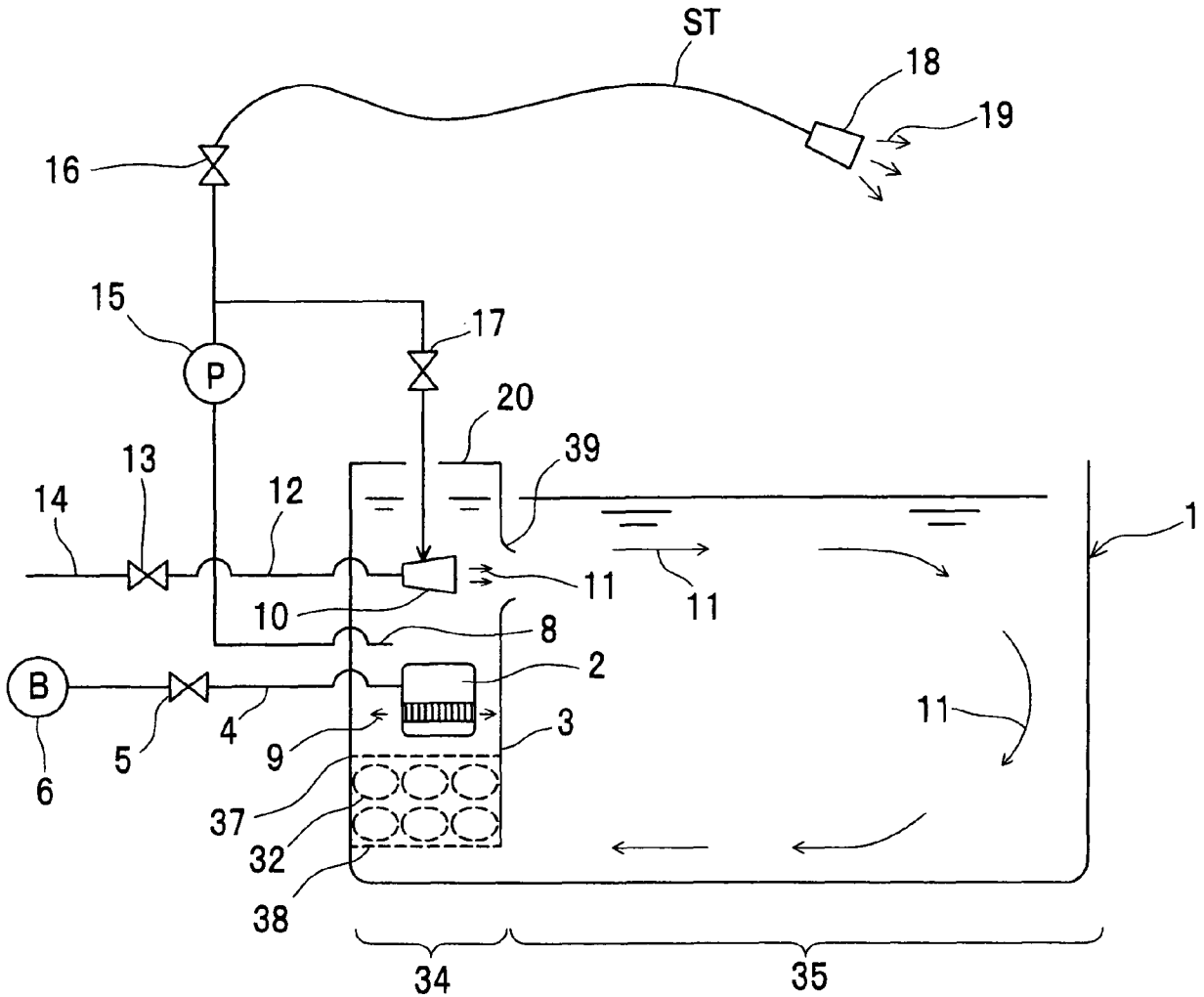
FIG. 6 is a schematic view showing a sixth embodiment of a micro-nano bubble bathtub in the present invention.

Next, FIG. 6 shows a sixth embodiment of a micro-nano bubble bathtub in the present invention. The sixth embodiment is different from the above-mentioned first embodiment in the following points (i)-(iii).

(i) An upper net 37 and a lower net 38 are newly placed in the lowermost part of the micro-nano bubble generation section 34.

(ii) A ring-type polyvinylidene chloride filling 32 is filled in between the upper net 37 and the lower net 38.

(iii) The bellow-like hose 22 and the flange 21 in FIG. 1 are deleted.

Therefore, in this sixth embodiment, component members identical to those in the first embodiment are designated by identical reference numerals to omit detailed description, and description will mainly be given of the portions different from the first embodiment.

In the sixth embodiment, the ring-type polyvinylidene chloride filling 32 was filled in between the upper net 37 and the lower net 38 placed in the lowermost part of the micro-nano bubble generation section 34. With the ring-type polyvinylidene chloride filling 32, the "dirt" generated in the micro-nano bubble bathtub 1 is made to adhere to the ring-type polyvinylidene chloride filling 32, so that the hot water and dirt in the bathtub can be separated, and therefore the hot water can be kept clean even if a plurality of persons take a bath.

In the sixth embodiment, the bellow-like hose 22 is not placed, so that a micro-nano bubble water stream 11 comes out from a micro-nano bubble water outlet 39 and spreads over the entire micro-nano bubble bathtub 1.

(Seventh Embodiment)

Figure 7:
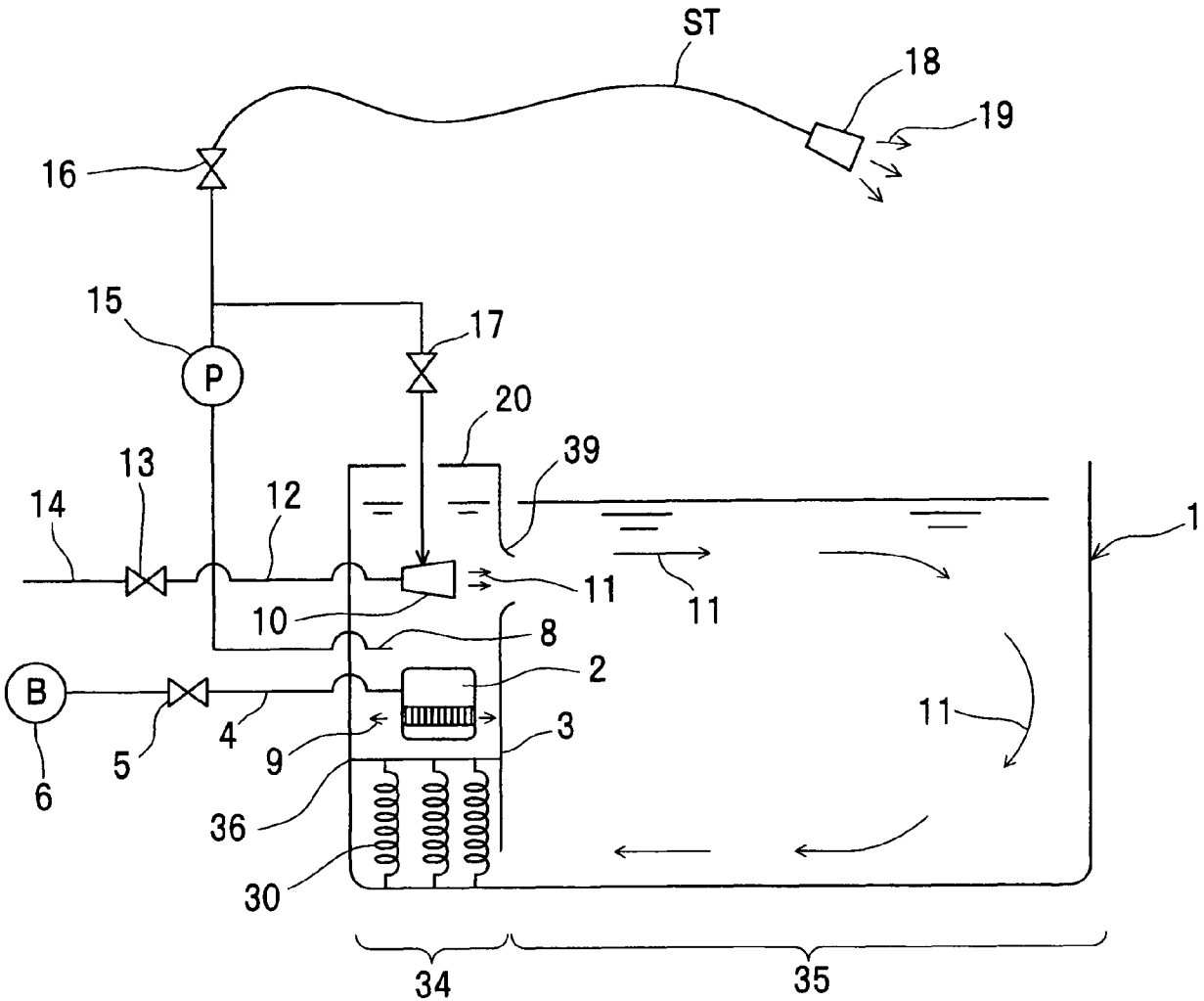
FIG. 7 is a schematic view showing a seventh embodiment of a micro-nano bubble bathtub in the present invention.

Next, FIG. 7 shows a seventh embodiment of a micro-nano bubble bathtub in the present invention. The seventh embodiment is different from the sixth embodiment in the point that in place of the upper net 37 and the lower net 38 in the above-mentioned sixth embodiment, a fixing bracket 36 is placed in the lower part of the micro-nano bubble generation section 34, and in the point that the ring-type polyvinylidene chloride filling 32 is replaced with a string-type polyvinylidene chloride filling 30.

Therefore, in this seventh embodiment, component members identical to those in the first embodiment are designated by identical reference numerals to omit detailed description. Description will only be given of the portions different from the first embodiment.

In the seventh embodiment, a string-type polyvinylidene chloride filling 30 is attached to the fixing bracket 36 placed in the lower part of the micro-nano bubble generation section 34. Therefore, the "dirt" generated in the micro-nano bubble bathtub 1 is made to adhere to the string-type polyvinylidene chloride filling 30, so that the hot water and dirt in the bathtub can be separated, and therefore the hot water can be kept clean even if a plurality of persons take a bath.

(Eighth Embodiment)

Figure 8:
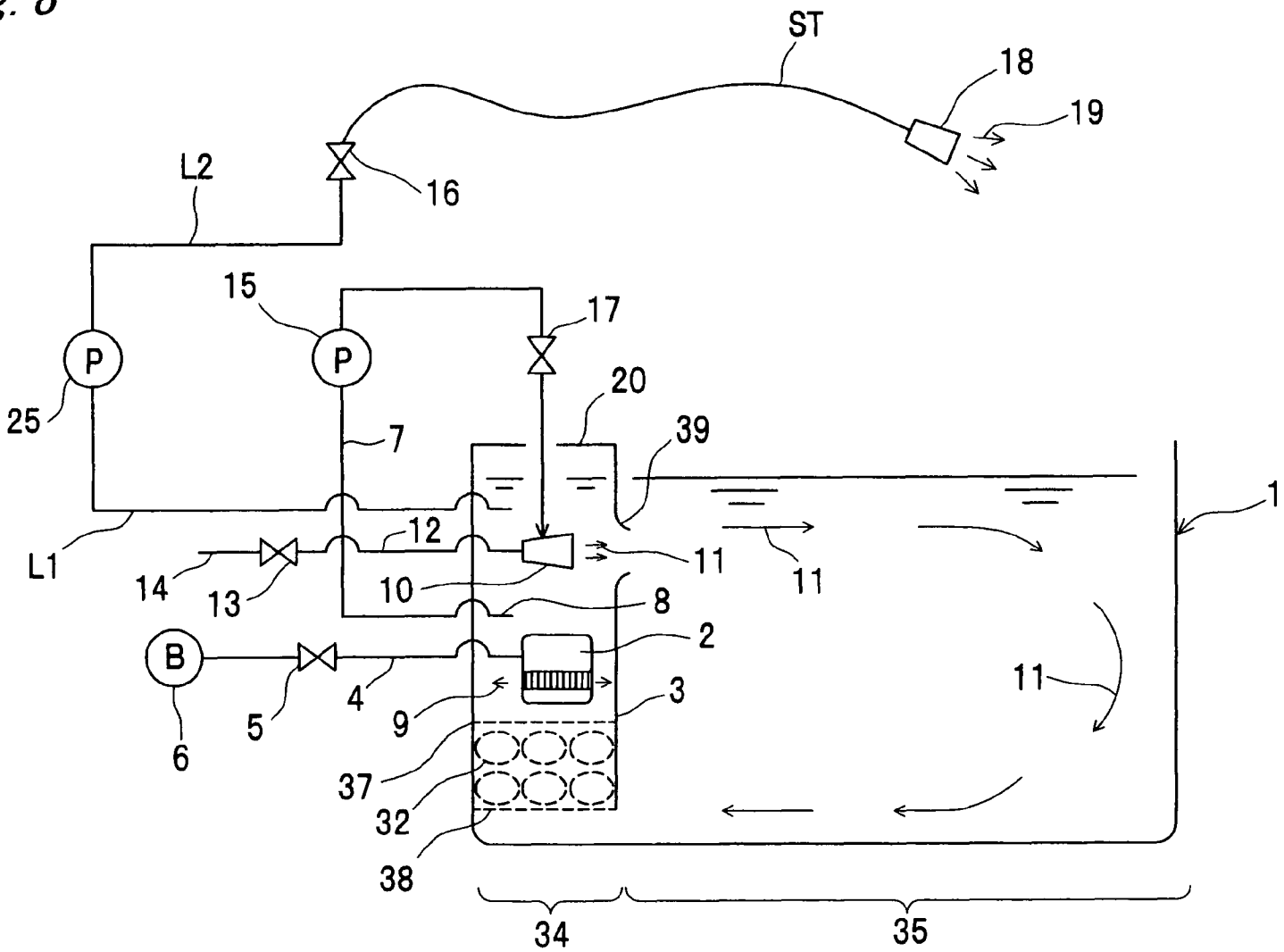
FIG. 8 is a schematic view showing an eighth embodiment of a micro-nano bubble bathtub in the present invention.

Next, FIG. 8 shows an eighth embodiment of a micro-nano bubble bathtub in the present invention. The eighth embodiment is different from the above-mentioned sixth embodiment in the point that the valve 16 in the shower section of the sixth embodiment in FIG. 6 is not connected to the pipe 7 but connected to a newly placed shower pump 25. That is, in the eighth embodiment, micro-nano bubble bathtub water (bathtub hot water) is supplied to the shower outlet 18 solely by the shower pump 25. Therefore, in this eighth embodiment, component members identical to those in the sixth embodiment in FIG. 6 are designated by identical reference numerals to omit detailed description, and description will only be given of the portions different from the sixth embodiment.

In the eighth embodiment, the shower pump 25 can pump bathtub water containing micro-nano bubbles above the spiral flow-type micro-nano bubble generator 10 in the upper part of the micro-nano bubble generation section 34 to the valve 16 from a pipe L2 via a pipe L1, and can sprinkle the bathtub water as shower water 19 from the shower outlet 18 through the shower tube ST.

Therefore, in the eighth embodiment, the shower pump 25 can be operated independently of the operation of the circulating pump 15 which supplies circulating water to the spiral flow-type micro-nano bubble generator 10. In short, in the eighth embodiment, regardless of operation and non-operation of the circulating pump 15, the shower pump 25 can be operated independently and a shower with water containing micro-nano bubbles can be used. Therefore, in the eighth embodiment, the shower can be used freely at any time and the shower with the water containing micro-nano bubbles can be used for application such as washing the human body and washing the hair of head.

(Ninth Embodiment)

Figure 9:
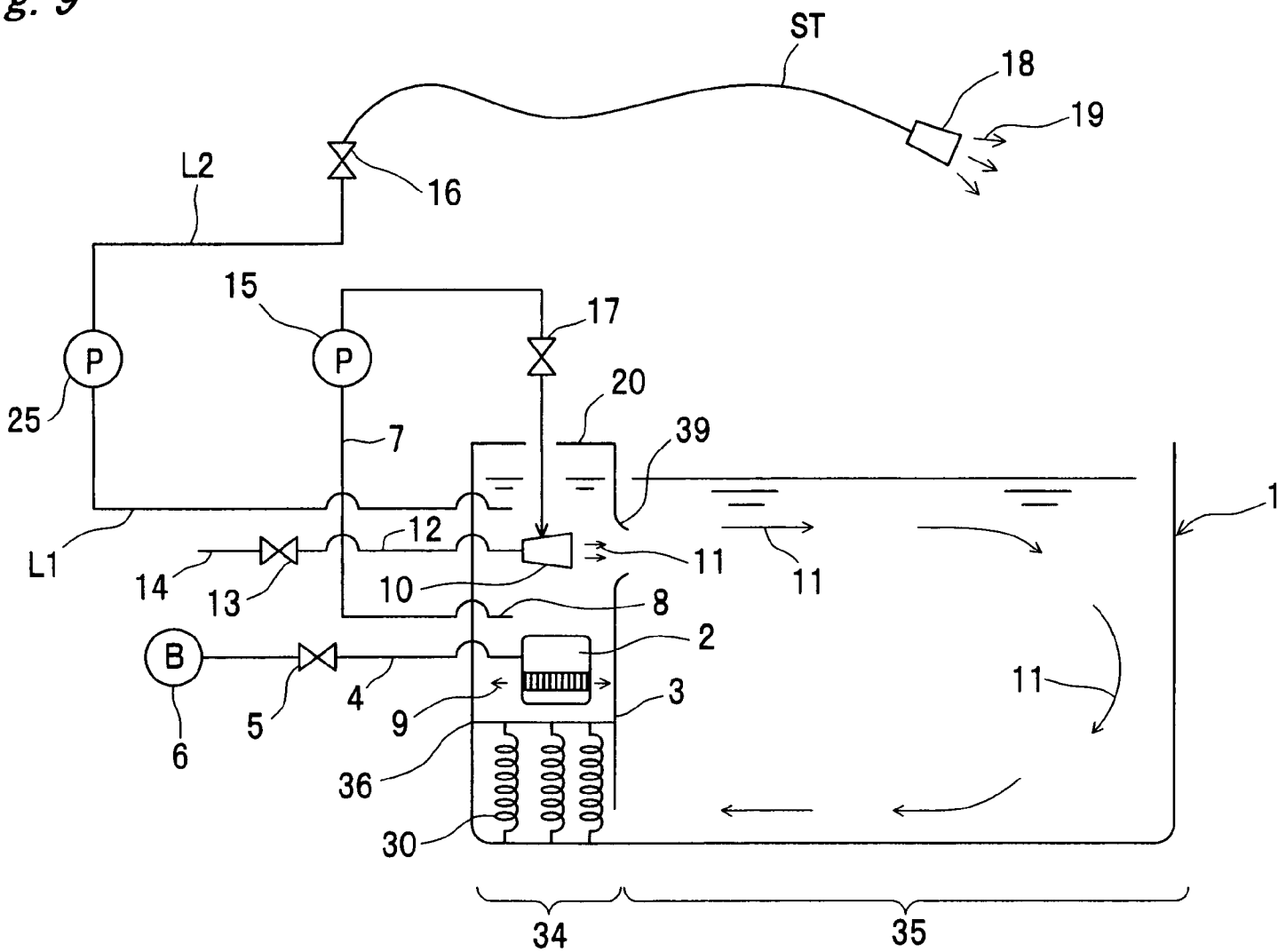
FIG. 9 is a schematic view showing a ninth embodiment of a micro-nano bubble bathtub in the present invention.

Next, FIG. 9 shows a ninth embodiment of a micro-nano bubble bathtub in the present invention. The ninth embodiment is different from the above-mentioned seventh embodiment in the point that the valve 16 in the shower section of the seventh embodiment in FIG. 7 is not connected to the pipe 7 but connected to a newly placed shower pump 25. That is, in the ninth embodiment, micro-nano bubble bathtub water (bathtub hot water) is supplied to the shower outlet 18 solely by the shower pump 25. Therefore, in this ninth embodiment, component members identical to those in the seventh embodiment in FIG. 7 are designated by identical reference numerals to omit detailed description, and description will only be given of the portions different from the seventh embodiment.

In the ninth embodiment, the shower pump 25 can pump bathtub water containing micro-nano bubbles above the spiral flow-type micro-nano bubble generator 10 in the upper part of the micro-nano bubble generation section 34 to the valve 16 from a pipe L2 via a pipe L1, and can sprinkle the bathtub water as shower water 19 from the shower outlet 18 through the shower tube ST.

Therefore, in the ninth embodiment, the shower pump 25 can be operated independently of the operation of the circulating pump 15 which supplies circulating water to the spiral flow-type micro-nano bubble generator 10. In short, in the ninth embodiment, regardless of operation and non-operation of the circulating pump 15, the shower pump 25 can be operated independently and a shower with water containing micro-nano bubbles can be used. Therefore, in the ninth embodiment, the shower can be used freely at any time and the shower with the water containing micro-nano bubbles can be used for application such as washing the human body and washing the hair of head.

(Tenth Embodiment)

Figure 10:
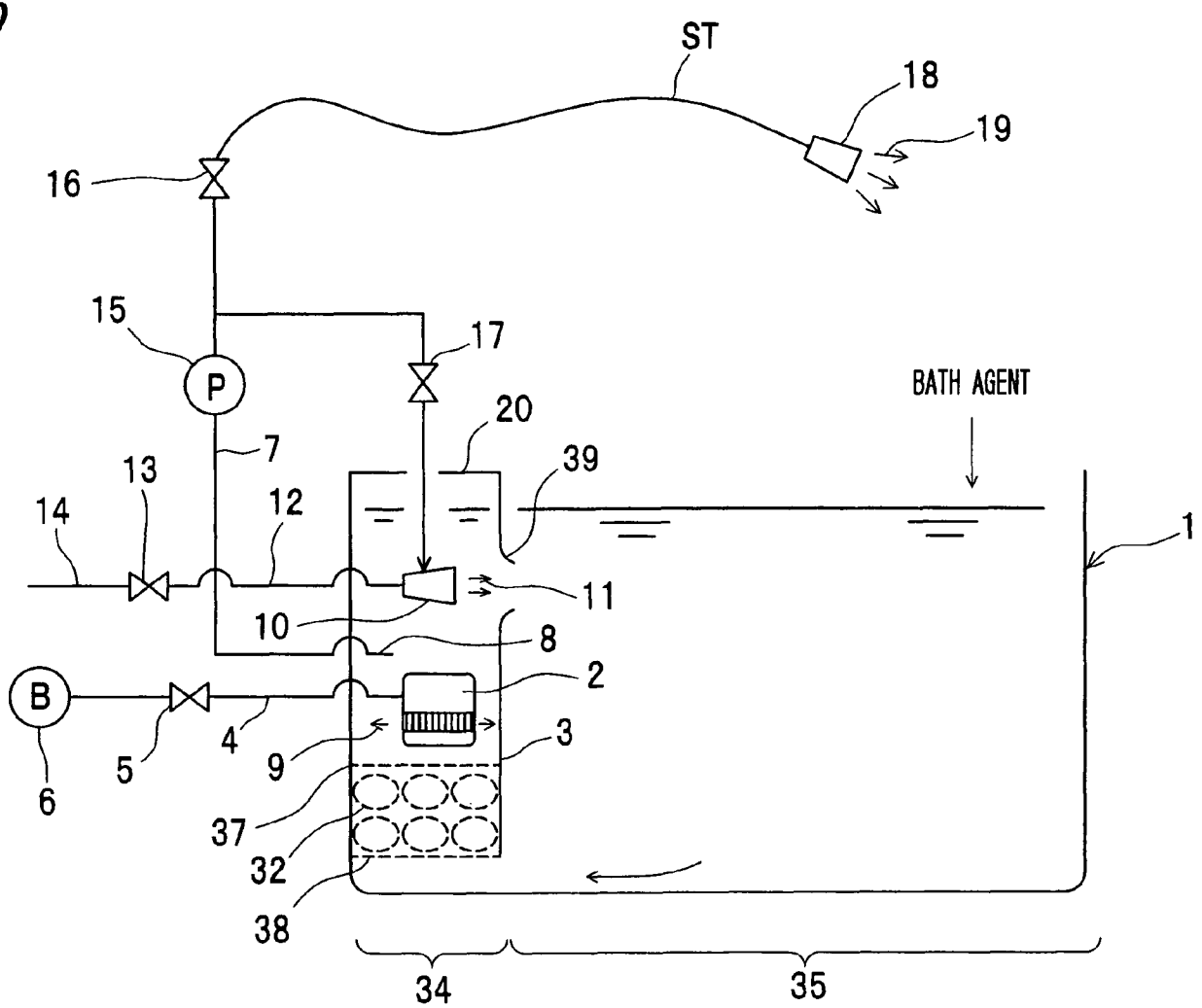
FIG. 10 is a schematic view showing a tenth embodiment of a micro-nano bubble bathtub in the present invention.

Next, FIG. 10 shows a tenth embodiment of a micro-nano bubble bathtub in the present invention. The tenth embodiment is different from the above-mentioned sixth embodiment in the point that a bath agent is added to the bathtub section 35 of the micro-nano bubble bathtub 1 in the sixth embodiment of FIG. 6. Therefore, in this tenth embodiment, component members identical to those in the sixth embodiment are designated by identical reference numerals to omit detailed description, and description will only be given of the portions different from the sixth embodiment.

In the tenth embodiment, the bath agent is added to the bathtub section 35 of the micro-nano bubble bathtub 1. It is to be noted that the bath agent may be added by facilities provided for adding bath agents or may be added simply by hand. In the tenth embodiment, the added bath agent helps micro-nano bubbles to be generated in optimal amount and size in bathtub water, thereby presenting the bathtub water like a milk bath. It should be understood that the generation state of the micro-nano bubbles differs by the types of bath agents.

(Eleventh Embodiment)

Figure 11:
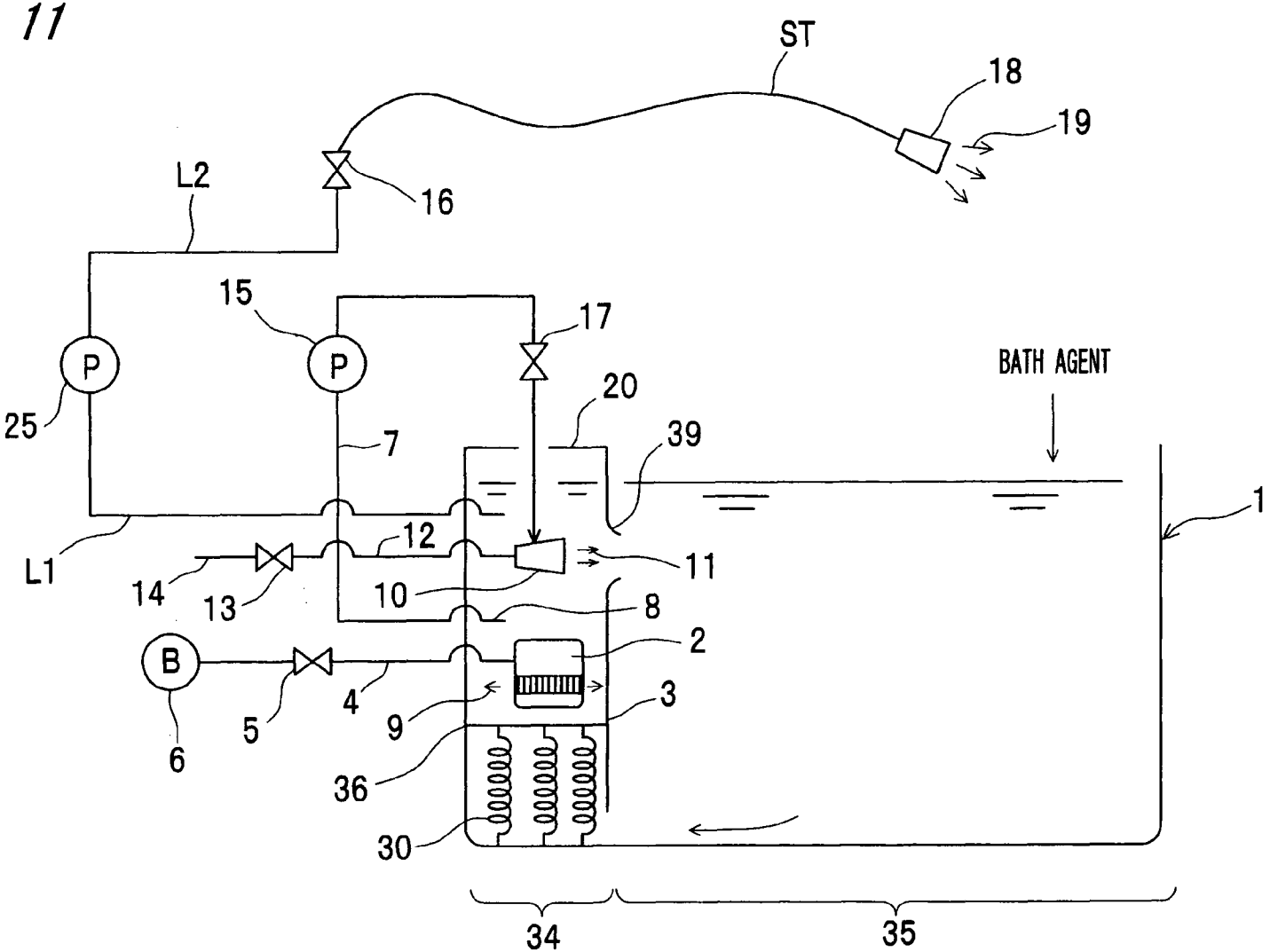
FIG. 11 is a schematic view showing an eleventh embodiment of a micro-nano bubble bathtub in the present invention.

Next, FIG. 11 shows an eleventh embodiment of a micro-nano bubble bathtub in the present invention. The eleventh embodiment is different from the above-mentioned seventh embodiment in the point that a bath agent is added to the bathtub section 35 of the micro-nano bubble bathtub 1 in the seventh embodiment of FIG. 7. Therefore, in this eleventh embodiment, component members identical to those in the seventh embodiment are designated by identical reference numerals to omit detailed description, and description will only be given of the portions different from the seventh embodiment.

In the eleventh embodiment, the bath agent is added to the micro-nano bubble bathtub 1. It is to be noted that the bath agent may be added by facilities provided for adding bath agents or may be added simply by hand. In the eleventh embodiment, the added bath agent helps micro-nano bubbles to be generated in optimal amount and size in bathtub water, thereby presenting the bathtub water like a milk bath. It should be understood that the generation state of the micro-nano bubbles differs by the types of bath agents.

EXPERIMENTAL EXAMPLE

An experimental device corresponding to the first embodiment shown in FIG. 1 was manufactured. In this experimental device, the experimental micro-nano bubble bathtub was manufactured with the capacity of the micro-nano bubble bathtub 1 being 0.2 $m^3$, the capacity of the micro-nano bubble generation section 34 in the micro-nano bubble bathtub 1 being 0.03 $m^3$, and the capacity of the bathtub section 35 being 0.17 $m^3$. A bath agent was added to the bathtub section 35 so that ideal generation of micro-nano bubbles was achieved to form the state of a milk bath. Pure white micro-nano bubbles were generated and applied to the leg for about 1 hour. Observation after leaving the bath revealed that the leg was red. It was also revealed that the numbness was temporarily eliminated. The fasting and postcibal levels of blood sugar concentrations were reduced 10% to 30% from the levels prior to the application of this measure.

Embodiments of the invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. A manufacturing method for micro-nano bubble bathtub water, comprising the steps for:

introducing bathtub water into a lower part of a micro-nano bubble generation section, which is partitioned from a bathtub section with a partition wall but is communicated with the bathtub section via a lower end of the partition wall, and generating a micro-nano bubble by a second micro-nano bubble generator arranged in the lower part of the micro-nano bubble generation section;

throwing the bathtub water containing micro-nano bubble from the lower part to an upper part of the micro-nano bubble generation section, which has a first micro-nano bubble generator and an equipment section covering arranged above the first micro-nano bubble generator;

sucking from a suction tube arranged between the second micro-nano bubble generator and the first micro-nano bubble generator the bathtub water containing micro-nano bubble into the first micro-nano bubble generator thereby micro-nano bubbles smaller in size than micro-nano bubbles generated by the second micro-nano bubble generator so as to generate two kinds of micro-nano bubbles different in size distribution of micro-nano bubbles in the micro-nano bubble generation section; and introducing the bathtub water containing the two kinds of micro-nano bubbles different in size distribution of micro-nano bubbles generated by the first and second micro-nano bubble generators into a bathtub section from a tip of a hose which is connected to the upper portion of the micro-nano bubble generation section and a vertical position of the tip corresponds to that of the second micro-nano bubble generator and a horizontal position of the tip apart from the second micro-nano bubble generator in the bathtub section.

2. A micro-nano bubble bathtub, comprising:

a bathtub section; and a micro-nano bubble generation section including an upper part having a first micro-nano bubble generator placed therein and an equipment section covering arranged above the first micro-nano bubble generator and a lower part having a second micro-nano bubble generator placed therein and bathtub water received from the bathtub section flowing from the lower part to the upper part; wherein the micro-nano bubble generating section comprising:

a partition wall partitioning the micro-nano bubble generation section from the bathtub section and communicating the lower part with the bathtub section via its lower end; and a suction tube being arranged between the second micro-nano bubble generator and the first micro-nano bubble generator and sucking the bathtub water containing micro-nano bubble generated by the second micro-nano bubble generator and introducing the bathtub water into the first micro-nano bubble generator; wherein the second micro-nano bubble generator generates micro-nano bubble in the bathtub water received from the bathtub section via the lower end of the partition wall, and the first micro-nano bubble generator sucks via the suction tube the bathtub water containing micro-nano bubble generated by the second micro-nano bubble generator and generates micro-nano bubbles smaller in size than micro-nano bubbles generated by the second micro-nano bubble generator, and the micro-nano bubble generation section further including a hose connected to the upper portion and a vertical position of a tip of the hose corresponds to that of the second micro-nano bubble generator and a horizontal position of the tip is apart from the second micro-nano bubble generator in the bathtub section and thereby introducing the bathtub water containing the two kinds of micro-nano bubbles different in size distribution of micro-nano bubbles generated by the first and second micro-nano bubble generators into the bathtub section from the tip of the hose.

3. The micro-nano bubble bathtub according to claim 2, wherein the first micro-nano bubble generator is a micro-nano bubble generator involving high-speed whirling, while the second micro-nano bubble generator is a micro-nano bubble generator involving rotary stirring.

4. The micro-nano bubble bathtub according to claim 2, comprising a hose for introducing bathtub water containing micro-nano bubbles into the bathtub section from the micro-nano bubble generation section, wherein the first micro-nano bubble generator is a micro-nano bubble generator involving high-speed whirling, while the second micro-nano bubble generator is a micro-nano bubble generator using a pressure solution pump.

5. The micro-nano bubble bathtub according to claim 2, comprising a hose for introducing bathtub water containing micro-nano bubbles into the bathtub section from the micro-nano bubble generation section, wherein the first micro-nano bubble generator is a micro-nano bubble generator involving high-speed whirling, while the second micro-nano bubble generator is a micro-nano bubble generator involving pressurization using a compressor.

6. The micro-nano bubble bathtub according to claim 2, comprising a hose for introducing bathtub water containing micro-nano bubbles into the bathtub section from the micro-nano bubble generation section, wherein the first micro-nano bubble generator is a micro-nano bubble generator involving high-speed whirling, while the second micro-nano bubble generator is a micro-nano bubble generator involving nozzle injection.

7. The micro-nano bubble bathtub according to claim 2, comprising a suction tube placed in between the first micro-nano bubble generator and the second micro-nano bubble generator for supplying bathtub water to the first micro-nano bubble generator.

8. The micro-nano bubble bathtub according to claim 2, comprising:

a shower section;

a water pipe arranged above the second micro-nano bubble generator in the micro-nano bubble generation section for supplying the bathtub water containing the micro-nano bubbles above the second micro-nano bubble generator to the shower section;

a circulating pump connected to the water supply pipe;

an air pipe for supplying air to the first micro-nano bubble generator; and a shower pipe for introducing the water containing micro-nano bubbles obtained from the water pipe to a shower section.

9. A micro-nano bubble bathtub, comprising:

a bathtub section; and a micro-nano bubble generation section including an upper part having a first micro-nano bubble generator placed therein and a lower part having a second micro-nano bubble generator placed therein and receiving bathtub water flowing from the lower part to the upper part, wherein the first micro-nano bubble generator generates micro-nano bubbles smaller in size than micro-nano bubbles generated by the second micro-nano bubble generator, and wherein bathtub water containing micro-nano bubbles is introduced into the bathtub section from the micro-nano bubble generation section, and the micro-nano bubble bathtub further comprising:

a surfactant tank;

a surfactant tank pump for pumping a surfactant from the surfactant tank to the bathtub section;

a turbidimeter for detecting turbidity of bathtub water in the bathtub section; and a control section for controlling operation of the surfactant tank pump based on a turbidity detection signal outputted by the turbidimeter.

10. The micro-nano bubble bathtub according to claim 9, wherein the surfactant is a body soap.

11. The micro-nano bubble bathtub according to claim 2, wherein a carbon dioxide gas generating solid is put in the bathtub section.

12. The micro-nano bubble bathtub according to claim 2, wherein the micro-nano bubble generation section has a string-type polyvinylidene chloride filling placed under the second micro-nano bubble generator in the lower part.

13. The micro-nano bubble bathtub according to claim 2, wherein the micro-nano bubble generation section has a ring-type polyvinylidene chloride filling placed under the second micro-nano bubble generator in the lower part.

14. The micro-nano bubble bathtub according to claim 2, wherein a bath agent is added to the bathtub section.

* * * * *